United States Patent [19]

Müller

[11] 4,172,531

[45] Oct. 30, 1979

[54] APPARATUS FOR TRANSFORMING A STREAM OF OVERLAPPING PAPER SHEETS INTO A STAPLE OF SHEETS

[75] Inventor: Hans Müller, Zofingen, Switzerland

[73] Assignee: Grapha-Holding AG, Hergiswil, Switzerland

[21] Appl. No.: 751,738

[22] Filed: Dec. 17, 1976

Related U.S. Application Data

[63] Continuation-in-part of Ser. No. 634,174, Nov. 21, 1975, abandoned.

[30] Foreign Application Priority Data

Dec. 29, 1975 [CH] Switzerland ..... 016813/75

[51] Int. Cl.[2] ..... B65H 33/18

[52] U.S. Cl. ..... 414/108; 93/93 D; 414/42; 271/181; 271/215

[58] Field of Search ..... 214/6 M, 7, 152; 271/177, 180, 181, 182, 213, 214, 215, 256; 93/93 D, 93 DP

[56] References Cited

U.S. PATENT DOCUMENTS

| | | | |
|---|---|---|---|
| 2,853,298 | 9/1958 | Faeber | 271/214 X |
| 2,855,833 | 10/1958 | Rugg et al. | 93/93 DP |
| 3,111,312 | 11/1963 | Swanson et al. | 271/181 |
| 3,131,932 | 5/1964 | Maidment | 271/181 X |
| 3,373,666 | 3/1968 | Crampton | 271/256 X |
| 3,445,107 | 5/1969 | Stoothoff | 271/214 X |
| 3,617,055 | 11/1971 | Stal | 93/93 DP X |
| 3,716,227 | 2/1973 | Bottcher | 271/180 |
| 3,842,719 | 10/1974 | Fernandez-Rana | 214/7 X |

FOREIGN PATENT DOCUMENTS

| | | | |
|---|---|---|---|
| 740191 | 10/1943 | Fed. Rep. of Germany | 271/181 |
| 766133 | 4/1934 | France | 271/214 |

*Primary Examiner*—L. J. Paperner

*Attorney, Agent, or Firm*—Peter K. Kontler

[57] ABSTRACT

Apparatus for conversion of a stream of partly overlapping sheets into a row of fully overlapping sheets has a first conveyor which transports a growing row of sheets at right angles to the planes of sheets, and a composite second conveyor which defines a downwardly extending path wherein successive sheets of the stream descend onto the first conveyor to accumulate between spaced-apart distancing elements of the first conveyor. The advancement of successive sheets all the way onto the first conveyor is assisted and promoted by oscillating fingers which engage the oncoming sheets immediately above the first conveyor and intermittently push such sheet in the direction of forward movement of the growing row to provide room for the oncoming sheet. A fully assembled row is lifted by a carriage and its outermost sheets, or suitable rigid panels which are inserted at the outer sides of the outermost sheets, are engaged by the jaws of a trolley which transports the row to a further processing station in a bookbinding machine. The panels can be inserted by hand or automatically; in the latter instance, the distancing elements are slotted and cooperate with slotted displacing members which eliminate bulges in the rearmost sheet of the fully assembled row and in the foremost sheet of the growing row on the first conveyor to facilitate automatic insertion of panels by a piston rod and a set of elastic rollers.

62 Claims, 8 Drawing Figures

V

B
24
91
85
54
127a
58
97
93
14A
A
90
25
4
97A
127
5
12
94
95
92
92
2

IV
IV
M
M
91
103a
105
106
105a
104
115
102
3
121
119
118
98A
112
108
111
107
120
13
98
14
97
6
97A
12
5
96
96A
95
100
92
2
127b
93
4
94
125
124
103
3F
101
110
123
114
113
122
109
116
117
99
90

APPARATUS FOR TRANSFORMING A STREAM OF OVERLAPPING PAPER SHEETS INTO A STAPLE OF SHEETS

CROSS-REFERENCE TO RELATED APPLICATION

This is a continuation-in-part of my copending application Ser. No. 634,174 filed Nov. 21, 1975 for "Apparatus for transforming a stream of overlapping paper sheets into a staple of sheets", now abandoned.

BACKGROUND OF THE INVENTION

The present invention relates to a method and apparatus for manipulating sheets of paper, cardboard or the like in bookbinding or other types of machines, and more particularly to improvements in a method and apparatus for converting a stream of signatures into rows or stacks of signatures. Still more particularly, the invention relates to improvements in a method and apparatus for converting a stream of successive non-overlapping or partially overlapping sheets (especially signatures) into rows or stacks or sheets. The invention also relates to improvements in means for and steps of manipulating the rows or stacks of sheets.

In many bookbinding machines, discrete sheets and/or signatures must be assembled into rows or stacks wherein each sheet or signature is in exact register with neighboring sheets or signatures. Such rows or stacks (hereinafter called rows) are thereupon introduced into a gathering machine wherein the sheets or signatures (hereinafter called signatures) of one type are assembled with one or more signatures of a different type prior to binding to form pamphlets, brochures, books or the like. Heretofore known methods and apparatus for assembly of signatures into rows are not entirely satisfactory for several reasons, especially as regards the accuracy and speed of assembly as well as the manipulation of assembled rows.

SUMMARY OF THE INVENTION

An object of the invention is to provide a novel and improved apparatus which can convert a stream of signatures, especially partly overlapping signatures, into successive rows each of which contains a predetermined number of fully overlapping signatures.

Another object of the invention is to provide the apparatus with novel and improved means for insuring the assembly of rows without any damage to or defacing of signatures, and with novel and improved means which enables the apparatus to begin with the assembly of a fresh row practically simultaneously with completion of assembly of the preceding row.

A further object of the invention is to provide the apparatus with novel and improved means for advancing successive signatures of a stream to the station where the signatures are assembled into rows.

An additional object of the invention is to provide novel and improved means for manipulating assembled rows without any damage to or defacing of signatures, especially the outermost signatures of the assembled rows.

An ancillary object of the invention is to provide novel and improved means for protecting the outermost signatures of fully assembled rows of signatures from damage during transfer from the station where the rows are assembled.

A further object of the invention is to provide a novel and improved system of conveyors for use in the above outlined apparatus.

An additional object of the invention is to provide the apparatus with novel and improved means for advancing the signatures of a growing row in synchronism with the operation of means which delivers signatures to the row forming station.

Another object of the invention is to provide an apparatus which can manipulate signatures of different size and/or shape, which can manipulate relatively thick or thin signatures, which can manipulate signatures consisting of or containing relatively stiff or readily flexible sheets of paper or the like, and which can be used in existing bookbinding or like machines as a superior substitute for existing apparatus.

A further object of the invention is to provide an apparatus which requires little attention on the part of attendants, whose operation can be automated to a degree greatly exceeding the automation of conventional apparatus, whch can be readily moved to and from the locus of use, and whose energy requirements are surprisingly low.

Another object of the invention is to provide the apparatus with novel and improved means for facilitating baling of successive rows of signatures without any damage to signatures, and with novel and improved means for supporting and shielding the rows during baling.

Another object of the invention is to provide a novel and improved method of converting a stream of signatures into discrete rows of signatures in such a way that the conversion can take place at a high speed, with a high degree of reproducibility and without any damage to and/or defacing of signatures.

A further object of the invention is to provide a method which can be resorted to for conversion of large or small, thick or thin, folded or unfolded and/or relatively stiff or readily flexible sheets or sets of sheets into rows wherein each sheet exactly overlies the neighboring sheet or sheets.

An ancillary object of the invention is to provide a novel and improved method of manipulating the rows of sheets, particularly of transporting such rows from the locus where the conversion of a stream into successive rows takes place.

One feature of the invention resides in the provision of a method of converting a stream of sheets, particularly a stream of partly overlapping signatures, into a succession of rows. The method comprises the steps of conveying the sheets of the stream along a predetermined path, intercepting successive sheets of the stream in a predetermined portion (e.g., at the lower end) of the path and moving successive intercepted sheets sideways so that such sheets form a growing row, and pushing successive rearmost sheets of the growing row in the direction of sidewise movement of the sheets at a predetermined frequency to provide room for advancement of successive sheets along and into the aforementioned portion of the path. The method may further comprise the step of intermittently arresting successive foremost sheets of the stream at the aforementioned frequency while such sheets approach the aforementioned portion of the path. Successive sheets of the stream (particularly folded sheets) are preferably compacted and thereby flattened ahead of the aforementioned portion of the path, preferably upstream of the path. The method may further comprise the steps of monitoring the sheets of the stream ahead of the path and interrupting the introduction of sheets into the path whenever the number of monitored sheets reaches a predetermined number.

Still further, the method may comprise the step of gripping the ends or the sides of the row when the number of sheets therein reaches a predetermined number, and moving the gripped row transversely of the direction of sidewise movement of sheets from the aforementioned portion of the path.

Another feature of the invention resides in the provision of an apparatus for converting a stream of sheets, particularly a stream of partly overlapping signatures, into a row of substantially fully overlapping sheets. The apparatus comprises first conveyor means (such first conveyor means may comprise two endless chains or belts) having a sheet-supporting surface which may but need not be horizontal and may be formed by the upper sides of slats which are attached to the links of the aforementioned chains, an air motor or other suitable means for moving the first conveyor means in a predetermined direction, preferably at any one of an infinite number of different speeds, a plurality of spaced-apart distancing means associated and movable with (e.g., secured to) the first conveyor means (the displacing means are disposed one behind the other, as considered in the direction of movement of the first conveyor means and extend beyond the supporting surface), and second conveyor means defining a predetermined path for the transport of sheets which form the stream to the supporting surface between two successive distancing means whereby such sheets form a growing row which accumulates on the supporting surface. The second conveyor means includes a portion (e.g., one or more endless belts) which extends at least to but preferably beyond the supporting surface. It can be said that the just discussed portion of the second conveyor means crosses in space with the first conveyor means. This insures that each sheet of the stream can be transported all the way to the supporting surface of the first conveyor means.

The second conveyor means preferably further comprises or is associated with a pusher or the like which is adjacent the supporting surface of the first conveyor means and means for moving the pusher back and forth substantially in and counter to the direction of movement of the first conveyor means (i.e., against and away from the last sheet of the growing row and/or the foremost sheet of the stream in the aforementioned path) to thereby provide room for advancement of the foremost sheet of the stream behind the last sheet of the growing row.

If the sheets are folded, e.g., if each element of the stream is a signature, the apparatus preferably further comprises means for compacting successive folded sheets ahead of the supporting surface, preferably upstream of the path. Such compacting (e.g., by causing the sheets to pass through the nip of two pressure rolls which are driven independently of the first and/or second conveyor means) insures a more predictable conversion of the stream into a succession of rows.

Certain other features of the apparatus reside in the provision of means for removing fully grown rows from the first conveyor means, in the provision of means for protecting the outermost sheets of each row against damage and/or defacing during transfer from the first conveyor means, in the provision of means for subdividing the stream into discrete groups of sheets each of which contains the same number of sheets (i.e., a number which suffices to form a fully assembled or grown row), in the provision of means for automatically attaching the aforementioned protecting means to the distancing means, and in the provision of means for regulating the speed of the means for moving the first conveyor means in dependency on the condition and/or position of the second conveyor means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
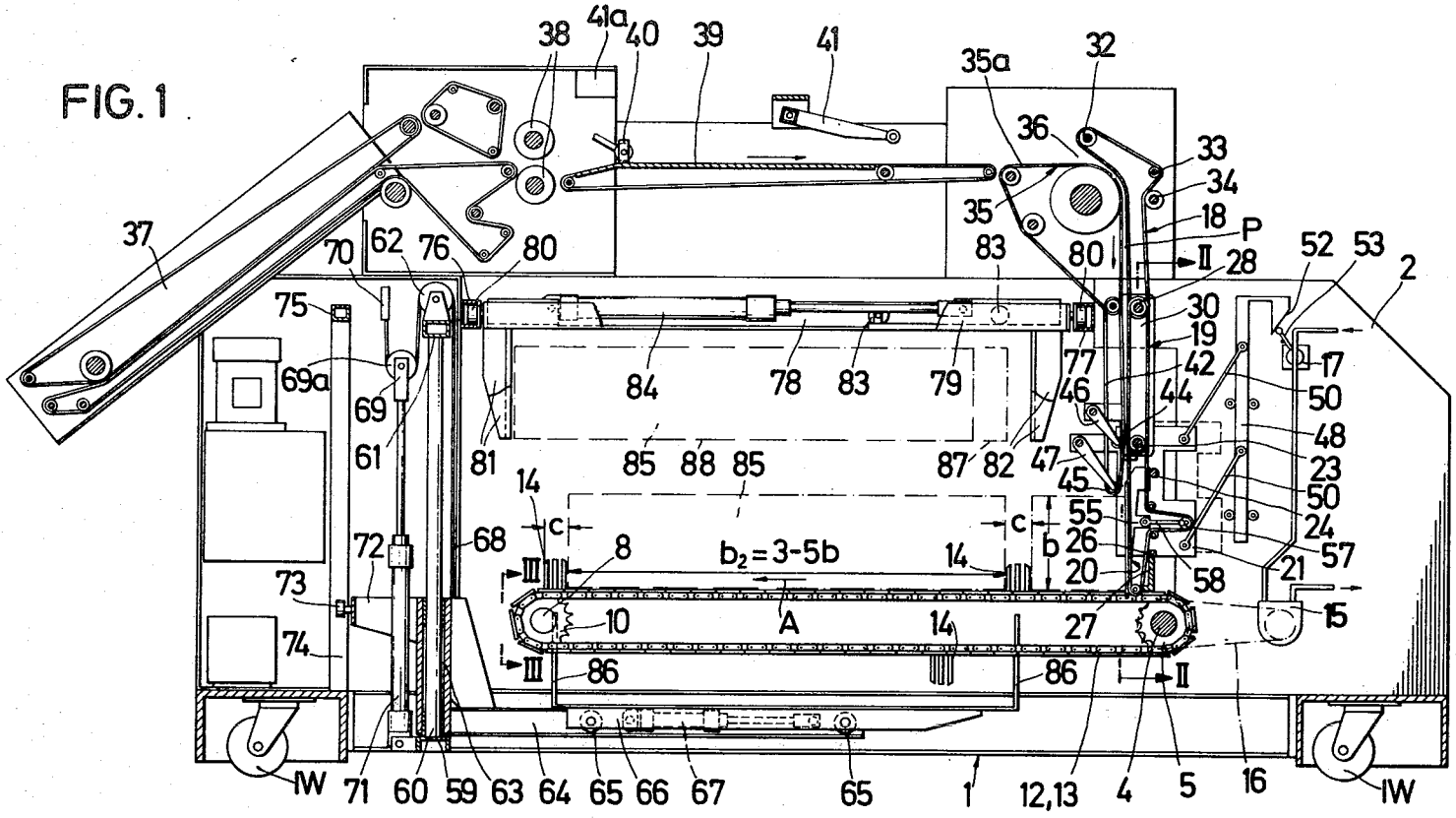
FIG. 1 is a longitudinal vertical sectional view of an apparatus which embodies one form of the invention.
Figure 2:
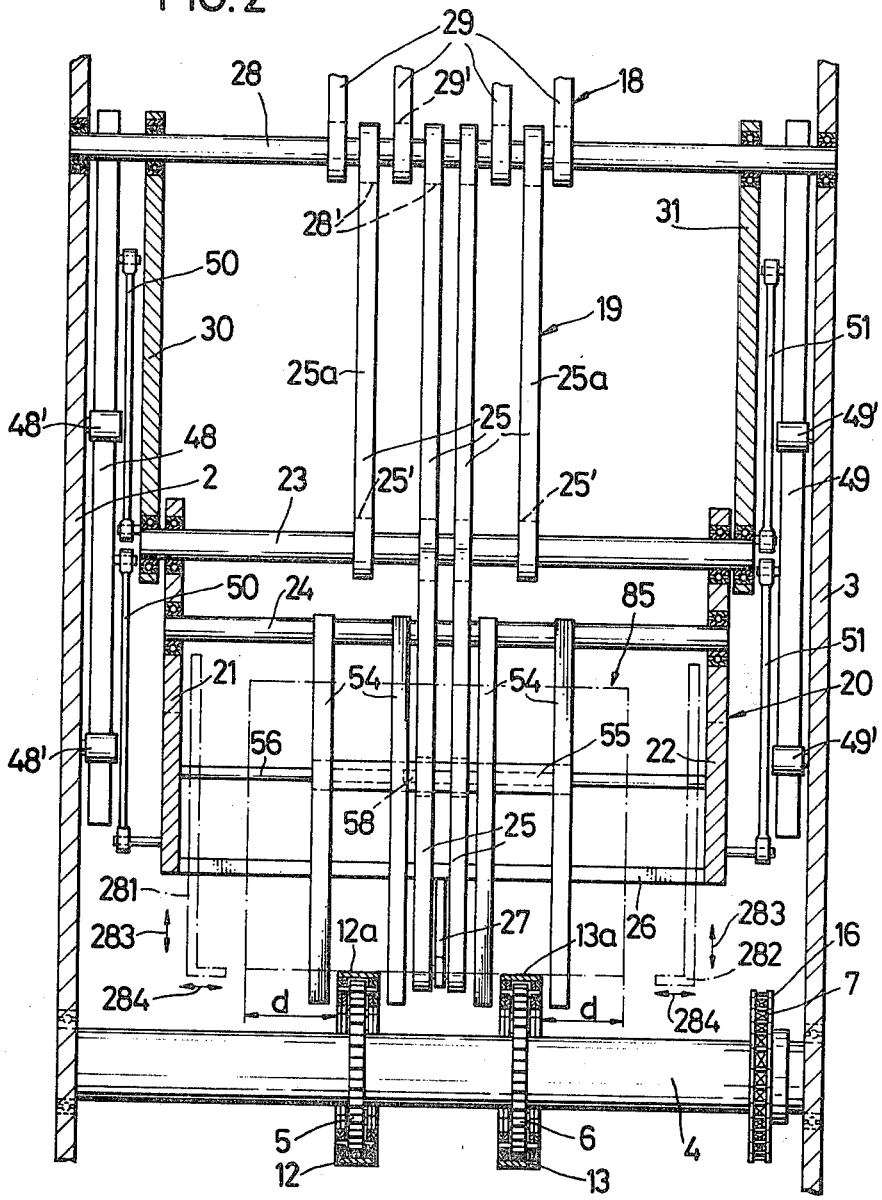
FIG. 2 is a fragmentary transverse vertical sectional view as seen in the direction of arrows from the line II—II of FIG. 1 or 1*a;*
Figure 3:
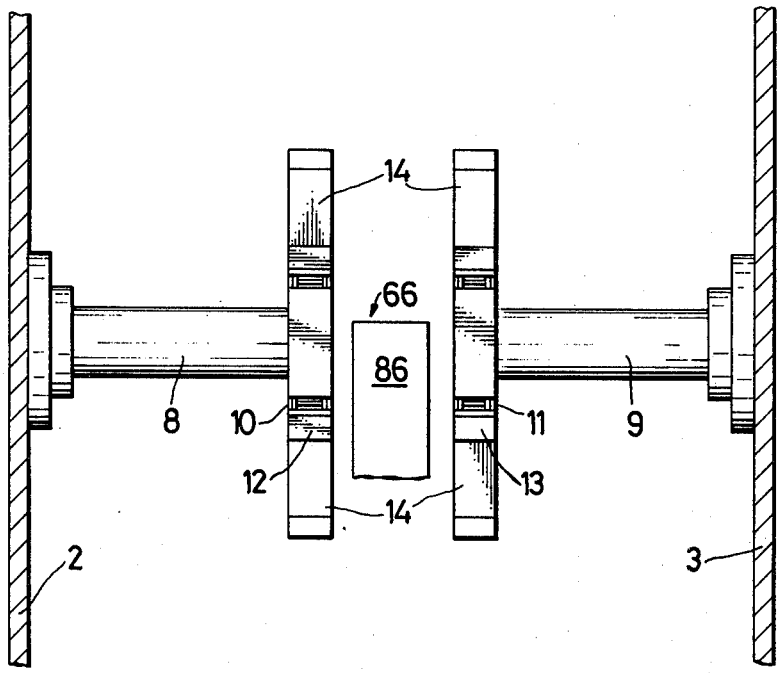
FIG. 3 is a fragmentary transverse vertical sectional view as seen in the direction of arrows from the line III—III of FIG. 1.

Referring to FIGS. 1 and 2, there is shown an apparatus which is used for conversion of a stream of partly overlapping signatures into rows of fully overlapping signatures and for manipulation of the rows in a bookbinding machine or the like. The apparatus comprises a rectangular frame 1 having a skeleton which is assembled of welded-together U-shaped or otherwise profiled frame members. The frame 1 further comprises two spaced-apart parallel plate-like upright side walls 2 and 3 which extend along the longer sides of and are secured to the frame members of the skeleton by bolts and nuts, by welding or in any other suitable way. The side walls 2 and 3 are provided with antifriction bearings (indicated in FIG. 2 by broken lines) for the end portions of a horizontal drive shaft 4 which is rigid with two coaxial sprocket wheels 5, 6 located substantially midway between the side walls 2 and 3. A third sprocket wheel 7 is mounted on the shaft 4 adjacent the inner side of the side wall 3. Two coaxial horizontal stub shafts 8 and 9 (see FIG. 3) are respectively mounted in the side walls 2 and 3 at the level of the drive shaft 4; these shafts respectively carry sprocket wheels 10 and 11 which are coplanar with the sprocket wheels 5 and 6, respectively. FIG. 3 shows that the inner end portions of the stub shafts 8, 9 and the sprocket wheels 10, 11

(which are rotatable relative to the respective stub shafts) are spaced apart from each other. The chain conveyor (first conveyor) which includes the sprocket wheels 5, 6, 10, 11 further comprises two endless link chains 12 and 13 which are respectively trained over the sprocket wheels 5, 10 and 6, 11. The planes of the chains 12, 13 are parallel to the planes of the side walls 2, 3. The upper reaches of the chains 12, 13 are horizontal and move in the direction indicated by arrow A (shown in FIG. 1) when the drive shaft 4 receives torque from a prime mover 15 (e.g., a variable-speed electric motor or an air motor) through the medium of the sprocket wheel 7. The latter is driven by an endless link chain 16. If the prime mover 15 is an air motor, its speed can be adjusted by a regulating valve 17. Each of the chains 12, 13 carries a set of equally spaced outwardly extending spacers or distancing elements 14, and each distancing element of the chain 12 is aligned with a distancing element of the chain 13. Each of the illustrated distancing elements 14 is a three-pronged fork. The slots between the prongs can receive plate-like inserts, not shown in FIGS. 1 to 3.

The links of the chains 12 and 13 preferably carry platforms or slats **12*a*, 13*a* which provide two continuous or nearly continuous supporting surfaces along the two upper reaches. These surfaces support from below successive signatures which descend onto chains 12, 13 in the region above the drive shaft 4**.

The weight of the material of the signatures may be in the range of 40 to 100 grams per square meter, and the size of each signature may range between 220×290 and 270×340 millimeters. Each signature may comprise between 8 and 80 sheets (i.e., 4 to 40 double sheets each of which is folded in the middle).

The frame 1 further supports a composite second conveyor which includes a series of discrete sections in the form of endless conveyors. One (19) of these discrete conveyors or sections includes two shorter endless belts **25*a* and two longer endless belts 25 which are disposed between the shorter belts 25*a* (see FIG. 2). The lower end turns of the belts 25 extend to a level below the upper reaches of the chains 12, 13, i.e., the lower portion of the conveyor 19 crosses in space with the first conveyor. The distance between the sprocket wheels 5 and 6 is sufficient to provide room for the lower end turns of the belts 25. The front or left-hand reaches of the belts 25 (as viewed in FIG. 1) are normal or substantially normal to the upper reaches of the chains 12 and 13. Another discrete section or conveyor 18 of the composite second conveyor is located at a level above the conveyor 19 and includes four endless belts 29 two of which flank the belts 25*a* and the other two of which flank the belts 25. The belts 29, 25 and 25*a* flank one side of a substantially vertical path P wherein a stream of partly overlapping signatures descends toward the upper reaches of the chains 12, 13 in the region of the drive shaft 4. The other side of the path P is flanked in part by a third discrete section or conveyor 35 having one or more endless belts 35*a* located opposite the belts 29 of the conveyor 18. The path P has a tapering inlet 36 at a level above the horizontal upper reach or reaches of the belt of belts 35*a*. The path P is further flanked by the rear reach or reaches of one or more endless belts 42 of an additional discrete section or conveyor 42A (see FIG. 1*a*) which is located opposite the belts 25*a* but extends to a level below the lower end turns of the belts 25*a*. The distance between the lower end turn or turns of the belt or belts 42 and the upper reaches of the chains 12, 13 slightly exceeds the height b of the rows of signatures which accumulate on the chains. It will be seen that the sections or conveyors 18, 19 flank one side of the path P and extend to a level below the upper reaches of the chains 12, 13, and that the sections or conveyors 35 and 42A flank the other side of the path P and extend to a level slightly above the upper side of the rearmost row of signatures on the chains 12, 13**.

The apparatus further comprises a pendulum type support 20 including two vertical plate-like bearing members 21, 22 (FIG. 2) which support two horizontal shafts 23, 24 disposed at different levels. The shaft 23 carries guide rollers 25' for the lower end turns of the belts **25*a* forming part of the conveyor 19. The rollers 25' are rigid with the shaft 23 which latter is rotatable in antifriction bearings provided therefor in the bearing members 21 and 22. A crosshead 26 is provided to rigidly connect the lower end portions of the bearing members 21 and 22 to each other. The crosshead 26 is rigid with the upwardly extending portion or leg of an L-shaped bracket 27 which is located between the belts 25 of the conveyor 19. The lower portion of the bracket 27 supports guide rollers 25'' for the lower end turns of the belts 25**.

A horizontal shaft 28 is mounted in bearings provided therefor in the side walls 2 and 3 (see FIG. 2). The shaft 28 carries guide rollers 28' for the upper end turns of the belts **25, 25*a* and guide rollers 29' for the lower end turns of the belts 29. Furthermore, the shaft 28 pivotably supports two levers 30, 31 which support the shaft 23 and hence the bearing members 21, 22. The levers 30, 31 flank the bearing members 21, 22 and serve to move the shaft 23 along an arcuate path whose center of curvature is located on the axis of the shaft 28. The bearing members 21, 22 can move the shaft 24 along an arcuate path whose center of curvatures is located on the axis of the shaft 23. The arrangement is such that the support 20 normally remains vertical or nearly vertical, in spite of pivotability of the levers 30, 31 on the shaft 28 and in spite of pivotability of the bearing members 21, 22 on the shaft 23**.

The belts 29 of the conveyor 18 are further trained over guide rollers 32, 33 and 34 which are rotatable on shafts secured to the side wall 2 and/or 3.

The inlet 36 of the path P receives a stream of partially overlapping signatures from a feeder conveyor 39 (preferably an endless belt conveyor) which, in turn, receives signatures from a feeder conveyor 37 here shown as including two endless belts. The conveyor 37 advances successive signatures into the nip of two pressure rolls or compacting rolls 38 which are installed in the frame 1 ahead of the feeder conveyor 39 and serve to compress and flatten each signature before the latter reaches the inlet 36. The signatures can be caused to partially overlap during travel with the conveyor 37 and/or by moving the conveyor 39 at a speed which is less than the speed of the conveyor 37.

A pivotable feeler or sensor 41 is installed in the frame 1 at a level above the feeder conveyor 39 and is pivoted anticlockwise (as viewed in FIG. 1) by successive signatures to thereby transmit signals to a counter **41*a* which records the number of signatures entering the path P. The counter 41*a* actuates an arresting or intercepting member 40 which is located between the sensor 41 and pressure rolls 38 and serves to arrest the signatures when the counter 41*a* furnishes a signal, i.e., when the path P has received a predetermined number of successive signatures. The intercepting member 40 remains operative for a preselected interval of time and thereupon reassumes its inoperative position in which the signatures which have been compressed or flattened by the rolls 38 are free to advance with the upper reach of the feeder conveyor 39 and on toward and into the inlet 36. The intercepting member 40 breaks up a continuous stream of signatures into a series of groups each of which consists of a predetermined number of signatures. Successive groups are separated from each other by gaps of predetermined length; the length of such gaps depends on the length of periods of dwell of the intercepting member 40** in its operative position.

The lowermost guide roller or guide rollers **35*b* for the belt or belts 35*a* of the conveyor 35 and the guide roller or guide rollers 42*b* for the upper end turn of the belt or belts 42 of the conveyor 42A are mounted on a horizontal shaft 43 which is supported by the side walls 2, 3. The belt or belts 42 further engage rollers 44, 45 which are respectively mounted on pairs of pivotable arms 46, 47. The arms 46 are mounted on the levers 30, 31 and the arms 47 are mounted on the bearing members 21, 22. The arms 46, 47 may but need not consist of an elastic material (e.g., spring steel). Also, such arms may be replaced by helical or other springs. The distance between the belt or belts 42 on the one hand and the adjacent portions of belts 25, 25*a* and 29 on the other hand is constant regardless of the fact that the shafts 23, 24 are movable sideways relative to each other and relative to the shaft 28**.

The means for biasing the bearing members 21, 22 of the support 20 so as to maintain such bearing members in substantially vertical positions, i.e., substantially at right angles to upper reaches of the chains 12, 13, comprises two weighted bars 48, 49 which are mounted on the side walls 2, 3 and are movable up and down between rollers 48', 49'. The bars 48, 49 are respectively connected to pairs of parallel links 50, 51 which, in turn, are articulately connected with the bearing members 21, 22. The parts 21, 22, 48, 49, 50, 51 form two parallel motion mechanisms. The bars 48, 49 may be charged by different weights for adjusting the force applied by the structure above the chains 12, 13 against the near end of the growing row.

The upper end portion of the bar 48 is formed with an inclined cam face 52 which is tracked by a roller follower 53 serving as a means for adjusting the regulating valve 17 for the air motor 15. The arm of the roller follower 53 is biased in a clockwise direction, as viewed in FIG. 1, so as to maintain the roller follower in permanent contact with the cam face 52. When the bar 48 moves upwardly, the cam face 52 causes the roller follower 53 to open the valve 17 to a greater extent so that the motor 15 receives a larger quantity of compressed air via conduit **15*a* and drives the chain 16 for the sprocket wheel 7 at a higher speed. The shaft 4, which drives the sprocket wheels 5, 6, then causes the upper reaches of the chains 12, 13 to advance at a higher speed (in a direction to the left, as viewed in FIG. 1). Inversely, when the bar 48 is caused to move downwardly, the roller follower 53 causes the valve 17 to reduce the speed of the motor 15 and hence the speed of the upper reaches of the chains 12 and 13**.

If the motor 15 is replaced with an electric motor, the valve 17 is replaced with a potentiometer or other suitable means for regulating the speed of the motor in response to displacement of the bar 48. It is equally within the purview of the invention to use a prime mover which includes a constant-speed motor and a variable-speed transmission which drives the shaft 4 and whose ratio is adjustable by the bar 48 through the medium of a cam-and-follower arrangement or other suitable means.

The apparatus also comprises a pusher having several fingers 54 whose upper end portions are mounted on the shaft 24. The fingers 54 extend downwardly toward the level of the upper reaches of the chains 12, 13 and are connected to each other by a traverse 55. Means is provided for pivoting or oscillating the lower portions of fingers 54 between a first end position in which the lower portions extend to the left of the lower portions of the left-hand reaches of belts 25 and a second end position in which the lower portions of the fingers 54 are located to the right of the lower portions of left-hand reaches of the belts 25, as viewed in FIG. 1 or **1*a*. The means for oscillating the fingers 54 comprises a shaft 56 which is affixed to and extends between the bearing members 21, 22 at a level below the shaft 24 and carries a wheel 57 having an eccentric pin 57' coupled to one end of a connecting rod 58 the other end of which is coupled to the traverse 55. The wheel 57 is driven by one of the belts 25 (i.e., by the composite second conveyor) and is rotatable relative to the shaft 56. This causes the lower portions of fingers 54 to oscillate between the aforementioned first and second end positions. It will be noted that the two outer fingers 54 can engage the respective lateral marginal portions of the adjacent signature and that the two median fingers can engage such signature in the space between the belts 25**.

A frame member 59 of the frame 1 (shown in the lower left-hand portion of FIG. 1) supports an upright column 60 which is located between the side walls 2, 3 and the upper portion of which is affixed to a second frame member 61 parallel to the frame member 59. The top part of the column 60 carries a roller 62 which is rotatable about a horizontal axis. The column 60 is surrounded by a sleeve 63 which is movable up and down and the lower portion of which is rigid with a horizontal guide rail 64. The latter defines a track for the rollers 65 of a vehicle here shown as a carriage 66 which is movable lengthwise of the first conveyor including the chains 12, 13. The means for moving the carriage 66 along the guide rail 64 comprises a double-acting fluid-operated motor 67 (preferably a pneumatic cylinder and piston unit) which is attached to the guide rail and to the carriage and is actuatable to shift the carriage in or counter to the direction indicated by arrow A. The sleeve 63 is connected to the lower end of a cable 68 which is trained over the roller 62 and around a pulley **69*a*. The upper end of the cable 68 is connected to a retainer 70 which is secured to the side wall 2 and/or 3. The pulley 69*a* forms a loop in that portion of the cable 68 which extends between the roller 62 and retainer 70. The means for moving the pulley 69*a* up and down and for thereby moving the sleeve 63 lengthwise of the column 60 comprises a hydraulic or pneumatic cylinder and piston unit 71 which is secured to the frame 1 and whose piston rod is attached to a U-shaped bracket 69 for the pulley 69*a*. The sleeve 63 thereby lifts or lowers the guide rail 64 for the carriage 66**.

The sleeve 63 has an arm 72 which is located at a level above the guide rail 64 and extends in a direction to the left, as viewed in FIG. 1. The free end of the arm 72 is provided with a roller 73 which is movable up and down in a track defined by a U-shaped rail 74. The rail 74 is secured to the base of the frame 1 and to a horizontal frame member 75 which is affixed to and extends between the side walls 2 and 3. The roller 73 cooperates with the rail 74 to prevent rotation of the sleeve 63 relative to the column 60.

Two horizontal rails 76, 77 extend between the side walls 2 and 3 at a level above the upper reaches of the chains 12, 13 at right angles to the direction indicated by arrow A. The rails 76, 77 define tracks for wheels 80 provided at the ends of a second vehicle here shown as a trolley which includes two horizontal beams 78, 79 extending in parallelism with the upper reaches of the chains 12 and 13. The trolley is movable in a horizontal plane at right angles to the direction of movement of signatures with the upper reaches of the chains 12, 13 and carries two downwardly extending gripping means or jaws 81 which are fixedly secured thereto close to the guide rail 76. Two additional gripping means or jaws 82 of the trolley are movable toward and away from the jaws 81, i.e., in and counter to the direction indicated by arrow A. The upper end portions of the jaws 82 have rollers or wheels 83 which can roll along the beam 78 and/or 79. The means for moving the jaws 82 toward or away from the jaws 81 comprises a fluid-operated motor here shown as a cylinder and piston unit 84 whose cylinder is rigid with the trolley and whose piston rod is coupled to the jaws 82.

The means for driving the feeder conveyors 37, 39, pressing rolls 38 and the discrete conveyors 18, 19, 35, 42A of the aforediscussed composite second conveyor are not shown in the drawing. It is preferred to provide a first drive for the feeder conveyor 37 and rolls 38, and an independent second drive for the conveyors 39, 35, 42A, 18, 19 which are located downstream of the pressure rolls 38, as considered in the direction of travel of signatures toward the upper reaches of the chains 12 and 13. This renders it possible to prevent a pileup of signatures upstream of the intercepting member 40 when the latter is caused to assume its operative position. At the same time, the conveyors 39, 18, 19, 35, 42A continue to transport the last signatures of a group toward the chain conveyor.

The operation of the apparatus of FIGS. 1, 1*a*, 2 and 3 is as follows:

A scalloped stream of partly overlapping signatures coming from a folding apparatus which is located downstream of a press, not shown, is advanced toward and transported between the endless belts of the feeder conveyor 37. Successive signatures are caused to pass through the nip of the pressure rolls 38 which flatten and compress each signature, especially the folded back which is located at the leading end of the respective signature. Successive signatures then reach and advance with the upper stretch or reach of the feeder conveyor 39 to be monitored by the sensor 41 which transmits signals to the counter 41*a*. The signatures then enter the downwardly extending path P via inlet 36 and descend toward and onto the upper reaches of the chains 12, 13. The motor 15 is on so that the upper reaches of the chains 12, 13 advance in the direction indicated by arrow A. The foremost signature of a growing row 85A on the chain conveyor is pressed against the preceding distancing element 14 under the action of the lower portions of the fingers 54. The upper portions of fingers 54 should not extend or should extend only slightly into the path P when their lower portions complete a forward stroke because, otherwise, the fingers would interfere with the descent of signatures toward the chains 12 and 13.

The counter 41*a* transmits a signal to the intercepting member 40 shortly before the chains 12, 13 accumulate a full row 85 of signatures. The member 40 then moves to the operative position and intercepts the oncoming signature which has advanced beyond or is still located in the nip of the pressure rolls 38. The signatures preceding the intercepted signature continue to advance toward the chains 12, 13 and form the last signatures of a complete row 85. The counter 41*a* further arrests the drive means for the feeder conveyor 37 and pressure rolls 38 to avoid a pileup of signatures in the region to the left of the intercepting member 40.

The length of a full row 85 on the chains 12, 13 is selected in such a way that the signatures of the full row fill the space between two successive distancing elements 14 on each of the chains 12 and 13. The interval during which the intercepting member 40 remains in operative position in response to a signal from the counter 41*a* is selected in such a way that the distancing elements 14 at the trailing end of a fresh row 85 advance beyond the lower end portion of the path P before the path receives the foremost signature of the next group. The assembly of the next row begins as soon as the last prongs of the just discussed distancing elements 14 allow the foremost signature to descend all the way onto the upper reaches of the chains 12 and 13.

Figure 1A:
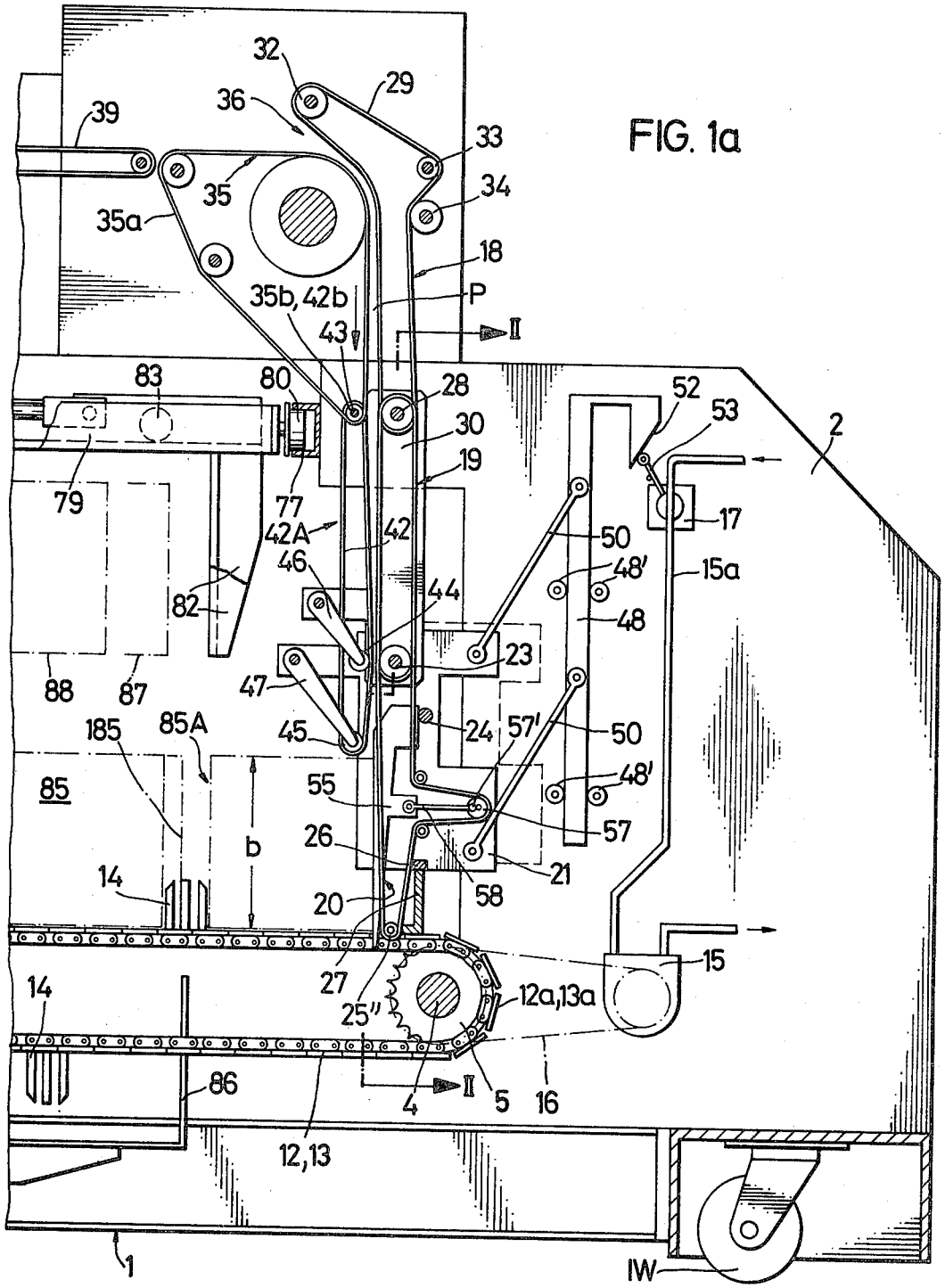
FIG. 1*a* is an enlarged view of the right-hand portion of the apparatus which is shown in FIG. 1.

The bars 48, 49 can be lifted automatically with a requisite delay subsequent to movement of the intercepting member 40 to its operative position to thereby retract the bearing members 21, 22 to the broken-line positions shown in FIG. 1 or 1*a*. The means for moving the bearing members 21, 22 to such retracted positions may include a motor which will be described with reference to FIG. 6.

The accumulation of a full row 85 of signatures on the chains 12, 13 is followed by transmission of a signal to actuating means (e.g., a system of valves) for the motor 71 which lifts the guide rail 64 and vehicle or carriage 66 through the medium of the cable 68 and sleeve 63. The width of the carriage 66 is less than the distance between the chains 12 and 13 (see FIG. 3) and the end portions of the carriage (as viewed in the direction indicated by arrow A) carry upwardly extending arms 86 spaced apart from each other by a distance which equals or preferably slightly exceeds the length of a full row 85. The carriage 66 lifts the row 85 off the chains 12, 13 and the arms 86 take over the function of the respective distancing elements 14 by preventing a collapse of the row 85, i.e., the signatures of the row on the carriage 66 remain in parallel vertical planes during movement upwardly toward and into the space between the jaws 81, 82 of the vehicle or trolley including the beams 78, 79. A lifted row in the space between the jaws 81 and 82 of the trolley is shown in FIG. 1 by phantom lines, as at 87. When the carriage 66 reaches its upper end position, the sleeve 63 or another part which shares such movement of the carriage 66 transmits a signal to the actuating mechanism (e.g., a system of valves) for the motor 84 which moves the jaws 82 toward the jaws 81 so that the length of the raised row 87 is reduced (see the condensed row 88 which is shown in FIG. 1). The jaws 81, 82 then maintain the row 88 under requisite compression to insure that the row 88 remains intact during the movement of trolley along the horizontal rails 76, 77 to a further station where the jaws 82 move away from the jaws 81 to release the row 88 which descends onto a table or a further conveyor, not shown. The table or conveyor can be provided with suitable supports for the ends of the row of signatures.

If the raised row 87 is sufficiently compact to be properly held between the jaws 81 and 82 without further compression or without appreciable additional compression, the motor 67 for the carriage 66 is started as soon as the carriage reaches its upper end position. The motor 67 then moves the carriage 66 and the row 87 toward the fixedly mounted jaws 81. When the leftmost signature of the row 87 abuts against the jaws 81, the row 87 assumes the position 88 and such movement of the carriage 66 triggers the operation of actuating means for the motor 84 which moves the jaws 82 into engagement with the rightmost signature of the row 88. From there on, the operation is the same as described above.

The carriage 66 is preferably lowered by the motor 71 before the trolley begins to move the row 88 at right angles to the plane of FIG. 1. The motor 67 is started when the carriage 66 reassumes the lower end position of FIG. 1 to return the carriage to its left-hand end position in which the carriage is ready to lift the next fully grown row which accumulates on the chains 12, 13. The carriage 66 descends before the growing row 85A on the chains 12, 13 reaches a length which is sufficient to interfere with downward movement of the carriage in the space between the chains.

The motor which moves the trolley back and forth along the rails 76, 77 is not shown in the drawing. Such motor may include a double-acting hydraulic or pneumatic cylinder and piston unit which is started as soon as the motor 78 completes the leftward movement of jaws 82 toward the jaws 81. The row 88 which has been transported from the position above the chain conveyor can be tied or baled by straps or the like prior to introduction into a further apparatus of the bookbinding machine. An apparatus which can accept tied rows or bales of signatures is disclosed, for example, in my copending application Ser. No. 719,578 filed Sept. 1, 1976, now U.S. Pat. No. 4,052,052.

The aforediscussed mounting of fingers 54 in such a way that their lower portions intermittently engage and push the descending signatures in the direction of arrow A constitutes a desirable and advantageous feature of the apparatus, especially when the apparatus is operated at a relatively high speed. The speed of the first conveyor (including the chains 12 and 13) depends on the speed of the composite second conveyor and on the thickness of signatures. When the stream of signatures is transported at an elevated speed, a satisfactory growing row 85A can be formed only if the pressure per unit area is uniform or nearly uniform in all regions of a growing row (as considered in a plane extending at right angles to the plane of FIG. 1). This necessitates a highly accurate synchronization of the speed of forward movement of the chains 12 and 13 with the speed of the composite second conveyor as well as with the thickness of signatures. A perfect synchronization is unlikely to be achieved in most instances because the thickness of signatures varies with thickness of their sheets, with the extent to which the signatures are compressed during passage through the nip of the rolls 38, with the number of folded sheets in a signature, with the quantity of air which is entrapped between the sheets of a signature, and in dependency on certain other factors. When the stream of signatures is advanced at an elevated speed, the thickness of individual signatures cannot be measured with a very high degree of accuracy (i.e., one must rely on an estimate of such thickness). This, in turn, prevents a perfect synchronization of the speed of chains 12 and 13 with the speed of the composite second conveyor. One possibility of insuring perfect synchronization would be to constantly monitor the pressure in the growing row 85A and to adjust the motor 15 accordingly. However, such measurement would involve the use of extremely costly and sensitive measuring instrumentalities without a guarantee that the instrumentalities would furnish readings or other indications (e.g., signals for automatic adjustment of the speed of the motor 15) which would be sufficiently reliable to insure perfect synchronization. It has been found that the fingers 54, especially when suspended in a manner as described in connection with FIG. 2, are capable of insuring a highly satisfactory equalization of pressures in the growing row 85A, i.e., an equalization of pressures which allows the apparatus to assemble successive rows with a heretofore unprecedented degree of reproducibility.

The length $b_2$ of a fully assembled or grown row 85 (i.e., the shortest distance between two neighboring distancing elements 14 on the chain 12 or 13) is preferably several times (e.g., 3–6 times and most preferably 4–5 times) the distance between the upper reaches of the chains 12, 13 and the rollers 45, i.e., the length of such row is several times the height b of a signature. A presently preferred length of a fully assembled row 85 is in excess of 100 centimeters, most preferably about 120 centimeters.

The frame 1 is mounted on pairs of wheels 1W to allow for convenient transport to or from the locus of use. If desired, at least one pair of wheels 1W can be driven by a discrete prime mover or by one of the aforementioned prime movers.

The thickness or length c of each distancing element 14 preferably exceeds the thickness of an arm 86 on the carriage 66 to insure that the trailing arm 86 can readily enter the space between a fully assembled row 85 and the growing row 85A in response to lifting of the carriage. The arms 86 then move upwardly in the space between the chains 12 and 13.

Figure 1B:
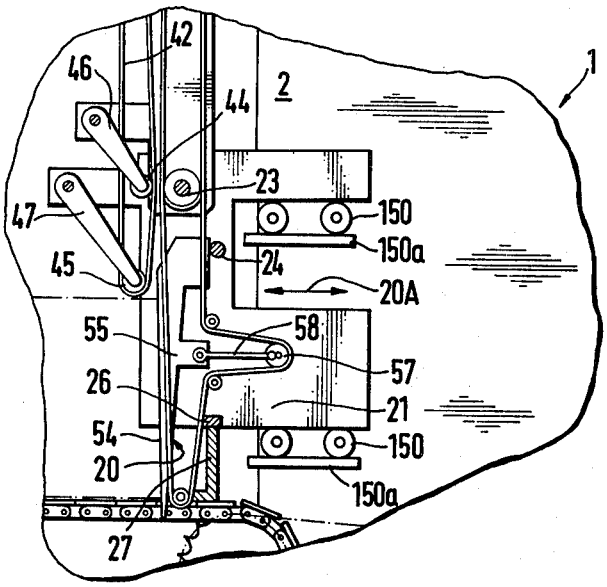
FIG. 1*b* is a fragmentary longitudinal vertical sectional view of a portion of a slightly modified apparatus.

FIG. 1*b* shows a slight modification of the apparatus of FIGS. 1, 1*a*, 2 and 3. The support 20 is reciprocable (rather than pivotable) in the frame 1. To this end, the bearing members 21, 22 have wheels 150 which can roll along horizontal guide rails 150*a* at the inner sides of the side walls 2 and 3. The directions of reciprocatory movement of the support 20 are indicated by arrow 20A.

The support 20 of FIG. 1*b* can be reciprocated by a double-acting cylinder and piston unit, by a rack-and-pinion drive, by an electromagnet or by any other suitable means (not shown). The manner of oscillating the fingers 54 of FIG. 1*b* is preferably (but need not be) the same as described in connection with FIGS. 1, 1*a* and 2.

In many instances, the signatures which form a row 85 or 85A extend laterally well beyond the chains 12, 13 and fingers 54. FIG. 2 shows that such rows can be removed by modified transfer means including two grippers 281, 282 which are movable up and down (see the arrows 283) as well as toward and away from each other (see the arrows 284). The means for moving the grippers 281, 282 up and down may comprise a carriage (not shown) which is installed at a level below or above the chains 12, 13 and is movable up and down by one or more double-acting cylinder and piston units or the like.

The means for moving the grippers 281, 282 toward and away from each other may comprise one or more racks on the carriage, pinions meshing with the racks and mounted on the grippers, and means for rotating each pinion clockwise or anticlockwise. Alternatively, the grippers 281, 282 can be connected to the ends of a cable which can be looped to move the grippers toward each other against the opposition of suitable biasing means, or vice versa.

Figure 4:
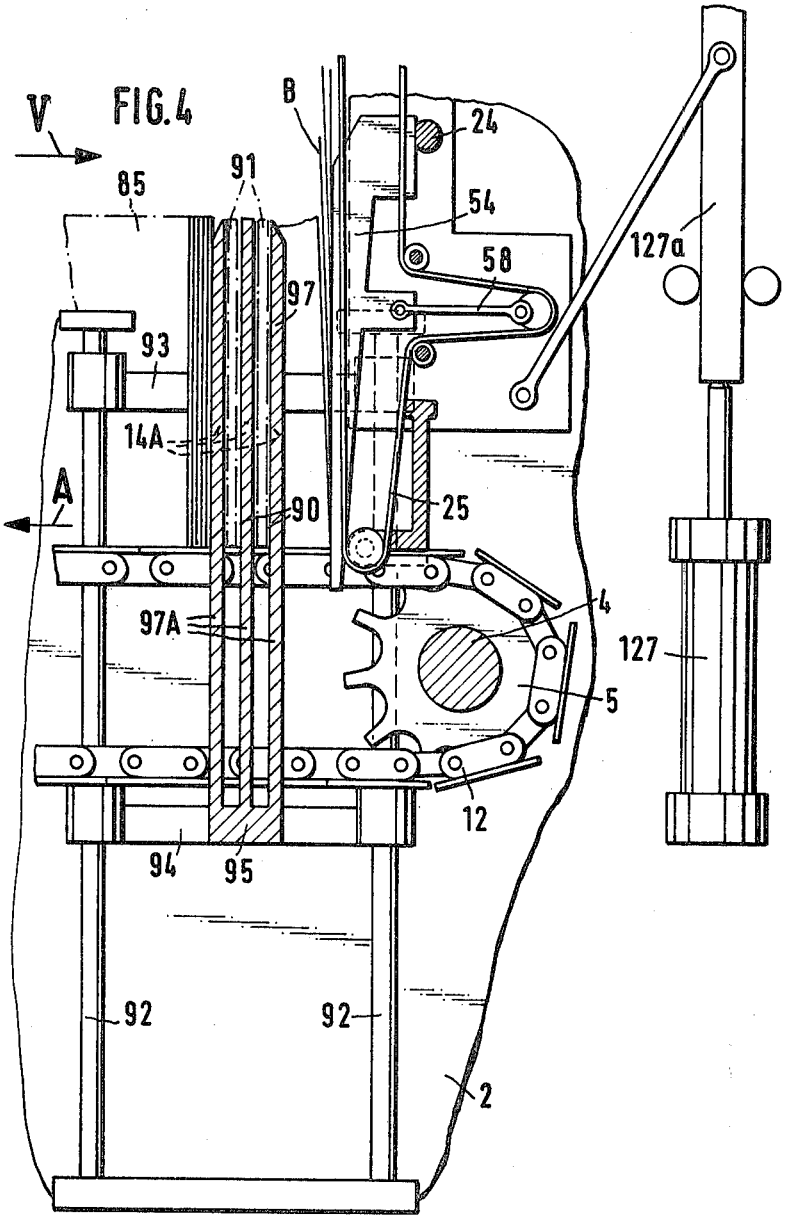
FIG. 4 is a fragmentary sectional view of a device which is used to insert protective platens in front of and behind the rows of signatures on the first conveyor means of the improved apparatus, the section being taken in the direction of arrows as seen from the line IV—IV of FIG. 5.
Figures 5, 6:
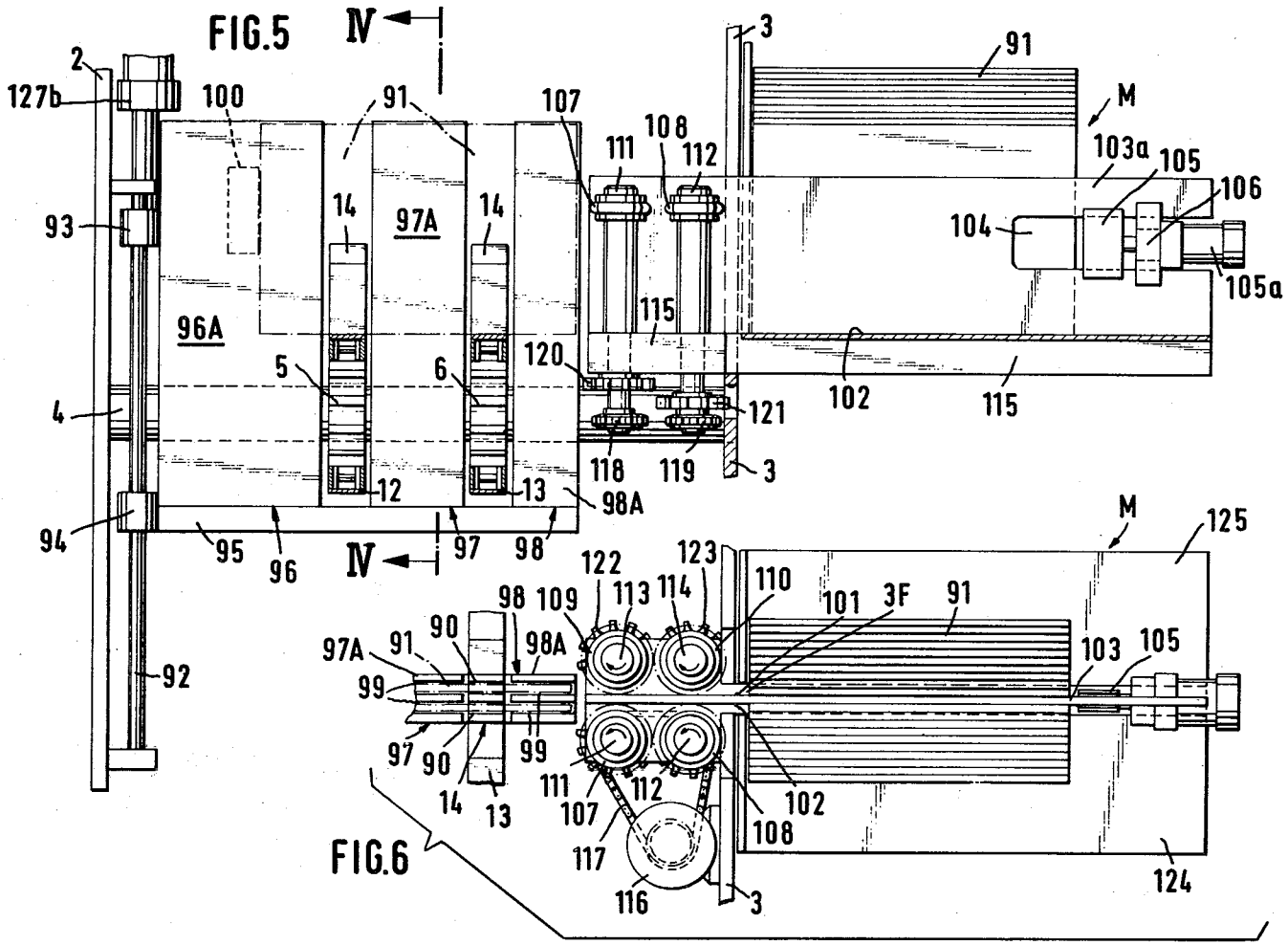
FIG. 5 is a view as seen in the direction of arrow V in FIG. 4.
FIG. 6 is a fragmentary plan view of the structure shown in FIG. 5.

Referring to FIGS. 4 and 6, there is shown a device which prevents damage to outermost signatures of a row 85 during lifting off the chains 12, 13 and during subsequent engagement of such row by the jaws 81, 82 of the trolley. As mentioned above, each of the distancing elements 14 comprises three prongs (shown at 14A in FIG. 4) which define recesses or slots 90 for introduction of rigid inserts or panels made of wood, metal, synthetic plastic material or the like. The purpose of panels is to prevent direct contact between the outermost signatures B of a row 85 and the upstanding arms 86 of the carriage 66 as well as between the outermost signatures of the lifted row (88 in FIG. 1) and the jaws 81, 82. Such panels also protect the outermost signatures of a row from damage when the row is converted into a bale by resorting to straps which are tied therearound. A bale can be placed into storage or transported to an apparatus (e.g., the apparatus shown in the aforementioned U.S. Pat. No. 4,052,052) which removes successive signatures from the bale to place such signatures onto a conveyor in a section of a bookbinding plant.

Problems arise in connection with insertion of panels into the slots 90 because the outermost (including the foremost and the rearmost) signatures of a row 85 on the chains 12, 13 tend to bulge outwardly in the space between the chains 12, 13 as well as in the spaces d (see FIG. 2) at the outer sides of such chains. As a rule, the signatures B extend transversely beyond the chains 12 and 13. For example, and referring to FIG. 1*a*, the rearmost signature of the fully assembled row 85 on the chains 12, 13 tends to bulge rearwardly (as indicated by the phantom line 185) beyond the foremost prong 14A of the respective distancing element 14. Therefore, the slot 90 behind the foremost prong 14A cannot readily receive a rigid panel except by subjecting the rearmost signature of the row 85 to pronounced deforming stresses which suffice to push the bulge 185 forwardly so that the bulge does not extend beyond the rear side of the foremost prong 14A. This often results in readily detectable damage to such signature. In fact, the compression of signatures which form a fully assembled row 85 is often so pronounced that it is impossible to insert a panel into the nearest slots 90 of the preceding and next-following distancing elements 14, even if one risks the likelihood of causing damage to the adjacent signatures.

The device of FIGS. 4 to 6 is designed to facilitate manual or automatic introduction of rigid inserts or panels (shown at 91 in each of FIGS. 4 to 6) in such a way that each insert or panel can be introduced with a minimum of effort (or with the expenditure of minimal amounts of energy if the insertion is automatic) and that the panels 91 cannot (or are unlikely to) damage and/or deface the adjacent signature or signatures B of a fully assembled or growing row. The just discussed device also reduces the likelihood of damage to distancing elements 14 during insertion or removal of panels 91 and increases the output of the apparatus of FIGS. 1 to 3 because the interval of time which is required for insertion of panels 91 is a small fraction of the interval which is required in an apparatus which does not embody the device of FIGS. 4–6. In fact, the improved device can be constructed, assembled and operated in such a way that the insertion of panels 91 into the slots 90 of the distancing elements 14 can take place simultaneously with other steps so that such introduction does not result in any delays.

All such parts of the structure shown in FIGS. 4 to 6 which are identical with or clearly analogous to the corresponding parts of the apparatus of FIGS. 1 to 3 are denoted by similar reference characters. As explained in connection with FIGS. 1 to 3, each distancing element 14 on the chain 12 of the chain conveyor is in exact register with a distancing element 14 on the chain 13, i.e., the prongs 14A and slots 90 of registering elements 14 are located in common planes. FIG. 4 shows the foremost signatures B of a scalloped stream of partially overlapping signatures which are converted into successive rows 85. The signatures descend onto the chains 12 and 13 by moving with the left-hand reaches of endless belts 25. The descent of signatures is promoted by the fingers 54 of the pusher whereby the fingers 54 further insure that the growing row 85A provides room for descent of successive signatures B all the way onto the chains 12 and 13. The fingers 54 are mounted on the shaft 24 and are oscillated by the connecting rod 58.

The deepmost or innermost portions of the slots 90 in the distancing elements 14 which extend upwardly from the upper reaches of the chains 12, 13 terminate at the general level of the signature-supporting upper surfaces of the respective slats 12*a*, 13*a*. However, it is also possible to employ distancing elements 14 with slightly shallower slots 90, i.e., with slots whose deepmost or innermost portions are located slightly above the underside of a row 85 or 85A on the chains 12 and 13.

The side wall 2 supports an upright guide rod or bar 92 which is adjacent the fingers 54 and chain 12. The guide member 92 is surrounded by two annular friction bearings 93 and 94 the latter of which is rigid with a horizontal arm or holder 95 for three upwardly extending displacing members 96, 97, 98. The displacing member 96 is outwardly adjacent the chain 12 (i.e., it is disposed in the space between the chain 12 and the side wall 2), the displacing member 97 is located in the space between the chains 12, 13, and the displacing member 98 is outwardly adjacent the chain 13. In order to enhance the rigidity of the unit including the arm or holder 95 and the displacing members 96–98, the upper portion of the displacing member 96 is preferably welded or otherwise fixedly secured to the upper bearing 93 (see FIG. 5). The holder 95 is located at a level below the lower reaches of the chains 12, 13 and is movable along the guide member 92 between a lower end position and an upper end position which is shown in FIG. 8. In the upper end position of the holder 95, the upper edge faces of the displacing members 96, 97 and 98 are preferably flush with the upper side of the row 85 or 85A on the chains 12 and 13. It will be noted that the height of distancing elements 14 is normally only a fraction of the height b of a row 85 or 85A. The height of panels 91 preferably equals the height b of a row 85 or 85A (except when the deepmost portions of slots 90 do not extend all the way to the upper reaches of the chains 12 and 13).

Each displacing member has three prongs (96A, 97A, 98A) and the prongs of each displacing member define two recesses or slots 99 having the same width as the recesses or slots 90 of the distancing elements 14. Thus, when two distancing elements 14 move into register with the displacing members 96–98, the slots 90 of such elements are coplanar with the slots 99 of the displacing members 96–98. This is shown in FIG. 6 for one distancing element 14 and the displacing members 97 and 98. The innermost portions of slots 99 are preferably flush with the innermost portions of registering slots 90 when the distancing members 96–98 assume the positions shown in FIG. 5.

The holder 95 for the displacing members 96 to 98 is movable up and down by a suitable motor, e.g., a double-acting hydraulic or pneumatic cylinder and piston unit 126 which is mounted on the side wall 2. When the piston rod of the motor 126 moves the displacing members 96 to 98 to the upper end position shown in FIG. 5, such displacing members eliminate any bulges of the adjacent signatures B (not only between and laterally of the registering pair of distancing elements 14 but also above the registering distancing elements) so that the two channels each of which consists of registering slots 90 and 99 can readily receive a pair of panels 91 which come to rest on the upper reaches of the chains 12 and 13 as long as the respective row remains on the first conveyor. The extent to which the panels 91 can be inserted into the aforementioned channels (each of which consists of two slots 90 and three slots 99) is determined by a preferably adjustable stop 100 which is mounted on or in the displacing member 96 or on a portion of the frame 1. The width of the panels 91, as considered at right angles to the direction indicated by arrow A, may but need not exceed the width of a row 85 or 85A. One of two inserted panels 91 abuts against the rearmost signature of a fully assembled row 85 and the other panel 91 abuts against the foremost signature of the growing row 85A.

The means for storing a supply of inserts or panels 91 includes a magazine M which is adjacent the outer side of the side wall 3 and includes an upright guide means or partition 103 which is coplanar with the median prongs 96A, 97A and 98A. The two sides 101, 102 of the partition 103 constitute guide faces along which two panels 91 can slide to enter the slots 99 of the raised displacing members 96–98 and the registering slots 90 of two distancing elements 14. The supply of panels 91 in the magazine M includes two sets one of which is adjacent the guide face 101 and the other of which is adjacent the guide face 102. The bottom walls 124, 125 of the magazine M are inclined downwardly toward the partition 103 so that the panels 91 of each set slide toward the respective guide face of the partition 103 in automatic response to transfer of two panels into the registering slots 90 and 99. The partition 103 extends laterally beyond the magazine M, through an opening 3F in the side wall 3, and close to the adjacent side of the displacing member 98. The opening 3F is large enough to allow two panels 91, which abut against the guide faces 101, 102 of the partition 103, to pass through the side wall 3 and into the slots 90 and 99. The bottom walls 124, 125 of the magazine M maintain the lower edge faces of the two innermost panels 91 (i.e., those panels which abut against the guide face 101 and 102) at the level of the deepmost portions of aligned slots 90 and 99, i.e., normally at the level of the upper surfaces of slats **12*a*, 13*a* located above the upper reaches of the chains 12 and 13. The thickness of the partition 103 equals the thickness of median prongs 14A and the thickness of median prongs 96A, 97A, 98A**.

The means for transferring two panels 91 from the magazine M into the registering slots 90 and 99 comprises two units. The first unit pushes and the second unit pulls the panels 91 onto the chains 12 and 13. As shown in FIGS. 5 and 6, the first unit is mounted on an extension **103*a* of the partition 103. This extension has a horizontal cutout or slot 104 which extends into the main portion of the partition 103, i.e., into the magazine M. A bracket 106 which is mounted on the extension 103*a* supporting the double-acting cylinder 105*a* of a hydraulic or pneumatic motor whose piston rod 105 is bifurcated and extends to both sides of the partition 103. When the piston rod 105 performs a forward stroke (in a direction to the left, as viewed in FIG. 5 or 6), it pushes the two innermost panels 91 through the opening 3F and into the range of elastic rollers forming part of the second (pulling) unit of the transferring means. The front portion of the piston rod 105 is preferably enlarged to constitute two plate-like shifters which can engage the adjacent edge faces of panels 91 abutting against the guide faces 101, 102**.

The elastic rollers of the second unit form two pairs of rollers 107, 109 and 108, 110. These rollers are respectively mounted on upright shafts 111, 113, 112, 114 which are rotatable in a platen 115 secured to the side wall 3. The platen 115 can form part of or constitutes a support for the magazine M. The prime mover for the rollers 107–110 is or includes a motor 116 whose output shaft drives an endless chain 117. The latter drives sprocket wheels 118, 119 on the shafts 111, 112 so that the rollers 107, 108 rotate anticlockwise, as viewed in FIG. 6. The shafts 111, 112 further carry additional sprocket wheels 120, 121 which drive an endless chain for sprocket wheels 122, 123 on the shafts 113, 114. The sprocket wheels 122, 123 cause the shafts 113, 114 to rotate the rollers 109, 110 in a clockwise direction, as viewed in FIG. 6.

The operation of the device of FIGS. 4 to 6 is as follows:

When the first conveyor accumulates a row 85, the conveyors which define the path P cease to deliver signatures B for an interval of time which is determined by the intercepting member 40. The delivery of signatures B to the chains 12 and 13 ceases when the distancing element 14 which is located immediately behind the fully assembled row 85 is in exact register with the displacing members 96 to 98. A photoelectric cell or another suitable detector (not shown) detects the gap in the stream of partly overlapping signatures B and transmits a signal to a motor 127 which swings the belts 25 and fingers 54 rearwardly by moving the piston rod **127*a* upwardly so that the apparatus is ready to begin with the accumulation of a fresh (growing) row 85A. Such movement of fingers 54 and/or belts 25 results in the generation of a signal which is transmitted to the controls for the motor 126 which lifts the displacing members 96–98 to the upper end positions shown in FIG. 5. The rising displacing members 96–98 eliminate eventual bulges of the rearmost signature B of the fully assembled row 85, i.e., the rear side of such rearmost signature does not extend beyond the rear sides of the foremost prongs 14A of the respective distancing elements 14. The slots 99 of the lifted displacing members 96–98 and the slots 90 of the distancing elements 14 behind the row 85 form two channels which are ready to receive two panels 91. The cylinder 105*a* is actuated as soon as the displacing members 96–98 reach their upper end positions and causes the piston rod 105 to move the two innermost panels 91 of the supply of panels in the magazine M along the guide faces 101, 102 of the partition 103 and to enter the nip of the elastic rollers 108, 110. These rollers advance the panels toward the rollers 107, 109 which continue to move the panels 91 forwardly into the respective channels and all the way into abutment with the stop 100. The peripheral speed of the rollers 107–110 may but need not exceed the speed of forward movement of the piston rod 105**.

In the next step, the motor 126 is actuated to lower the displacing members 96–98 and the motor 15 for the chains 12, 13 is started to drive the chains at an elevated speed. The speed of the motor 15 is reduced when the front reaches of the belts 25 reassume their normal vertical positions, i.e., when such reaches are normal or substantially normal to the upper reaches of the chains 12 and 13.

When the carriage 66 is caused to rise, its rear arm 86 enters the space between the two platens 91 in the distancing elements 14 behind the fully assembled row 85 on the chains 12, 13, and the front arm 86 moves upwardly in front of the single remaining platen 91 in the distancing elements 14 located immediately ahead of the fully assembled row 85 (the other platen 91 has been removed with the preceding row). Thus, the thickness of the rear arm 86 should not exceed the thickness of the median prong 97A of the displacing member 97.

As shown in FIG. 1, the height of distancing elements 14 is preferably (but not necessarily) less than the height b of a row 85 or 85A. Therefore, the rearmost signature B of a fully assembled row 85 is more likely to bulge rearwardly at the level above the corresponding distancing elements 14. Moreover, the backs B1 of signatures B are normally stiffer than the portions thereabove; consequently, the lowermost portion of a fully assembled row 85 exhibits a relatively small bulge. This is of advantage in connection with movement of displacing members 96–98 to the upper end positions shown in FIG. 6. Thus, as the members 96, 97 and 98 rise, their upper portions (which may be rounded to further reduce the likelihood of damage to adjacent signatures) begin to slide first along the backs B1 of the nearest signatures and begin to push the signatures back (i.e., the rearmost signature of the row 85 on the chains 12, 13 is pushed forwardly and the foremost signature of the row 85A is pushed rearwardly) subsequent to entry into the gaps between the respective distancing elements 14 (member 97) and into the spaces laterally of such distancing elements (members 96 and 98).

It will be readily appreciated that the displacing members 96–98 contribute significantly to convenience of insertion of platens 91. If the platens were to be inserted by hand and the apparatus would not be equipped with the device of FIGS. 4 to 6, it would be necessary to flex the outermost signatures by hand in order to provide room for insertion of platens into the spaces 90 regardless of whether the platens would be inserted from above, from one side or from the other side of the first conveyor. It should be borne in mind (see FIG. 2) that the signatures B normally extend laterally beyond the chains 12, 13 and their distancing elements 14, i.e., the outermost signature of a fully assembled row 85 is likely to flex rearwardly beyond the upper edge faces as well as beyond the outer lateral edge faces of the foremost prongs 14A of both distancing elements 14 which are located behind such fully assembled row.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for converting a stream of sheets, particularly a stream of partly overlapping signatures, into a row of substantially fully overlapping sheets, comprising first conveyor means having a sheet supporting surface; means for moving said first conveyor means in a predetermined direction; a plurality of spaced-apart distancing means movable with said conveyor means, said distancing means being disposed one behind the other, as considered in said direction, and extending beyond said supporting surface; second conveyor means defining a predetermined path for the transport of sheets which form said stream to said supporting surface intermediate two successive distancing means whereby such sheets form a growing row which accumulates on said supporting surface, said second conveyor means including a portion adjacent said supporting surface and means for repeatedly moving said portion back and forth substantially in and counter to said direction against and away from the last sheet of said growing row to thereby provide froom for advancement of the foremost sheet of said stream behind the last sheet of said growing row; a mobile support for said portion of said second conveyor means; and drive means for moving said support in and counter to said direction.

2. Apparatus as defined in claim 1, wherein said portion of said second supporting means extends at least to said supporting surface.

3. Apparatus as defined in claim 2, wherein said portion of said second conveyor means crosses the plane of said sheet supporting surface.

4. Apparatus as defined in claim 2, wherein said means for moving said first conveyor means includes means for moving said supporting surface transversely of said path so as to move said growing row away from said portion of said second conveyor means.

5. Apparatus as defined in claim 2 for converting said stream into a row of predetermined height, wherein the spacing between successive distancing means, as considered in said direction, is a multiple of said predetermined height.

6. Apparatus as defined in claim 5, wherein said spacing equals between three and six times said predetermined height.

7. Apparatus as defined in claim 2, wherein said portion of said second conveyor means is a pusher.

8. Apparatus as defined in claim 7, wherein said pusher comprises a plurality of discrete fingers.

9. Apparatus as defined in claim 1, wherein said means for moving said portion of said second conveyor means includes means for moving said portion in said direction with an at least substantially constant force.

10. Apparatus as defined in claim 1, wherein said means for repeatedly moving said portion of said second conveyor means comprises means for moving said portion between first and second end positions in one of which said portion bears against the last sheet of the growing row or against the foremost sheet of said stream to push such sheet in said direction and in the other of which said portion provides room for movement of the foremost sheet of said stream toward said supporting surface.

11. Apparatus as defined in claim 10, wherein said portion of said second conveyor means is located at one side of said path and said second conveyor means includes a second portion located at the opposite side of said path and spaced apart from said supporting surface.

12. Apparatus as defined in claim 10, wherein said first conveyor means comprises a plurality of endless flexible elements disposed in parallel planes.

13. Apparatus as defined in claim 12, wherein said flexible elements are chains having slats which define said supporting surface.

14. Apparatus as defined in claim 10, wherein said second conveyor means defines a funnel-shaped inlet for said path.

15. Apparatus as defined in claim 10, wherein said second conveyor means comprises a plurality of endless flexible elements including at least one flexible element at one side and at least one flexible element at the other side of said path.

16. Apparatus as defined in claim 10, further comprising means for feeding sheets into said path, including third conveyor means arranged to transport a stream of non-overlapping sheets, and having means for converting said last mentioned stream into a stream of partly overlapping sheets, and fourth conveyor means for feeding successive sheets of said last mentioned stream into said path.

17. Apparatus as defined in claim 1, wherein said sheets are folded and sheets in said predetermined path partially overlap each other, and further comprising means for compacting successive folded sheets of said stream before such sheets reach said supporting surface.

18. Apparatus as defined in claim 17, wherein said compacting means is located ahead of said path, as considered in the direction of transport of sheets toward said supporting surface.

19. Apparatus as defined in claim 18, further comprising third conveyor means for feeding sheets to said compacting means and fourth conveyor means for feeding compacted sheets from said compacting means to said second conveyor means.

20. Apparatus as defined in claim 17, wherein said compacting means comprises two driven pressure rolls.

21. Apparatus as defined in claim 20, further comprising discrete drive means for said pressure rolls and said second conveyor means.

22. Apparatus for converting a stream of sheets, particularly a stream of partly overlapping signatures, into a row of substantially fully overlapping sheets, comprising first conveyor means having a sheet supporting surface; means for moving said conveyor means in a predetermined direction; a plurality of spaced-apart distancing means associated and movable with said conveyor means in said direction, said distancing means being disposed one behind the other, as considered in said direction, extending beyond said supporting surface, and having a predetermined thickness, as considered in said direction; second conveyor means defining a predetermined path for the transport of sheets which form said stream to said supporting surface between two successive distancing means whereby such sheets form a growing row which accumulates on said supporting surface and, when fully grown, extends between said two successive distancing means; and means for removing the fully grown row from said supporting surface, including a vehicle comprising two portions each having a thickness which at most equals the thickness of said distancing means and each registering with a different one of said two successive distancing means when such distancing means confine a fully grown row, and means for moving said vehicle transversely of said supporting surface so that the vehicle removes the fully grown row from said first conveyor means and the thus removed row is confined between said portions of said vehicle.

23. Apparatus as defined in claim 22, wherein said supporting surface is substantially horizontal and said vehicle is movable between a first position at a level below and a second position at a level above said supporting surface.

24. Apparatus as defined in claim 22, wherein each of said distancing means comprises a pair of spaced apart distancing elements in register with each other, as considered transversely of said direction, said portions of said vehicle being disposed between the elements of the distancing means which confine a fully grown row.

25. Apparatus as defined in claim 22 for converting a stream of sheets into a row having a predetermined width, as considered transversely of said direction, wherein each of said distancing means has a width which is less than said predetermined width so that each of said two successive distancing means engages only a portion of the outermost sheet at the respective end of the fully grown row, said portions of said vehicle being movable into engagement with those portions of the outermost sheets of a fully grown row which are not engaged by the respective distancing means.

26. Apparatus as defined in claim 22, wherein said second conveyor means has a portion which crosses the plane of said sheet supporting surface so that said second conveyor means can transport successive sheets of said stream all the way to said supporting surface.

27. Apparatus as defined in claim 22, wherein said second conveyor means includes a portion adjacent said supporting surface and means for moving said portion of said second conveyor means in and counter to said direction against and away from the last sheet of said growing row to thereby provide room for advancement of the foremost sheet of said stream behind the last sheet of the growing row.

28. Apparatus as defined in claim 22 for converting a stream of folded sheets into a row of sheets, further comprising means for flattening successive folded sheets of said stream.

29. Apparatus as defined in claim 22, wherein said distancing means are slotted and further comprising means for introducing rigid plate-like inserts into the slots of said distancing means.

30. Apparatus as defined in claim 22, further comprising means for interrupting said stream of sheets shortly prior to accumulation of a fully grown row of sheets on said supporting surface.

31. In an apparatus for assembling flexible sheets, particularly signatures, into rows of overlapping sheets, a combination comprising first conveyor means including a plurality of spaced-apart distancing means each having at least one recess extending transversely of the direction of movement of said conveyor; second conveyor means arranged to deliver sheets to said first conveyor means intermediate two successive distancing means to form a row which, when fully assembled, fills the space between the respective distancing means and the outermost sheets of which tend to bulge outwardly beyond the respective distancing means; sheet displacing means adjacent said first conveyor means and having at least one second recess; means for moving said displacing means to and from a predetermined position in which said second recess registers with the first recess of the distancing means at one end of the fully assembled row and said displacing means eliminates any bulges of the adjacent outermost sheet of such row; and a substantially rigid insert receivable in the recesses of said displacing means and the registering distancing means to prevent renewed bulging of the adjacent outermost sheet upon movement of said displacing means from said predetermined position.

32. A combination as defined in claim 31, wherein each of said distancing means comprises two aligned distancing elements which are spaced apart from each other, as considered transversely of the direction of movement of said first conveyor means, each distancing element having a portion of the respective first recess, said displacing means including a portion which is disposed between the distancing elements of a distancing means when said displacing means assumes said predetermined position.

33. A combination as defined in claim 32, wherein said first conveyor means has a supporting surface for the sheets of a row thereon and said first recesses have innermost portions disposed at the general level of said supporting surface, said second recess having an innermost portion which is flush with the innermost portions of said first recesses in said predetermined position of said displacing means.

34. A combination as defined in claim 31, wherein said first conveyor means has a substantially horizontal sheet-supporting surface and said means for moving said displacing means includes a device for moving said displacing means between a lower end position and an upper end position, said upper end position constituting said predetermined position.

35. A combination as defined in claim 31, further comprising guide means for said inserts, an insert which abuts said guide means being in register with said second recess and the corresponding first recess in said predetermined position of said displacing means so that such insert can be introduced into the registering first and second recesses by moving it along said guide means.

36. A combination as defined in claim 35, wherein each of said distancing means has two parallel first recesses and said displacing means has two parallel second recesses each of which registers with a first recess of the adjacent distancing means in said predetermined position of said displacing means, said guide means having two guide faces for two discrete inserts each of which registers with a second recess in said predetermined position of said displacing means.

37. A combination as defined in claim 35, further comprising means for supporting said last mentioned insert from below during entry into the registering first and second recesses.

38. A combination as defined in claim 35, further comprising means for moving inserts along said guide means into the registering first and second recesses.

39. A combination as defined in claim 38, wherein said last mentioned moving means comprises means for pushing inserts toward the registering first and second recesses.

40. A combination as defined in claim 38, wherein said last mentioned moving means comprises means for pulling inserts toward the registering first and second recesses.

41. A combination as defined in claim 40, wherein said pulling means comprises at least one driven elastic roller.

42. A combination as defined in claim 41, wherein each of said inserts is a flat panel and said roller is rotatable about an axis which is substantially parallel to the plane of the panel registering with said second recess.

43. A combination as defined in claim 35, further comprising a magazine for a supply of inserts, said magazine having means for feeding successive inserts of said supply against said guide means.

44. A combination as defined in claim 43, wherein said feeding means includes a bottom wall which supports said supply from below and is inclined downwardly toward said guide means.

45. Apparatus for converting a stream of sheets, particularly a stream of partially overlapping signatures, into a row of substantially fully overlapping sheets, comprising first conveyor means having a sheet supporting surface; means for moving said first conveyor means in a predetermined direction; a plurality of spaced-apart distancing means associated and movable with said first conveyor means, said distancing means being disposed one behind the other, as considered in said direction, and extending beyond said supporting surface; second conveyor means defining a predetermined path for the transport of sheets which form said stream to said supporting surface between two successive distancing means whereby such sheets form a growing row which accumulates on said supporting surface and has a predetermined width, as considered transversely of said direction, said second conveyor means including a portion which extends at least to said supporting surface and each of said distancing means having a width less than said predetermined width so that a portion of a row on said supporting surface extends laterally beyond at least one side of said two successive distancing means; and means for removing fully grown rows from said supporting surface, including means for engaging said laterally extending portions of such rows.

46. Apparatus for converting a stream of sheets, particularly a stream of partially overlapping signatures, into a row of substantially fully overlapping sheets, comprising first conveyor means having a sheet supporting surface; means for moving said first conveyor means in a predetermined direction; a plurality of spaced-apart distancing means associated and movable with said first conveyor means, said distancing means being disposed one behind the other, as considered in said direction, and extending beyond said supporting surface; second conveyor means defining a predetermined path for the transport of sheets which form said stream to said supporting surface between two successive distancing means whereby such sheets form a growing row which accumulates on said supporting surface, said second conveyor means including a portion which extends at least to said supporting surface and said second conveyor means further comprising a mobile support adjacent said supporting surface and a plurality of sheet engaging members movably mounted in said support; means for moving said support in and counter to said direction; and means for moving said sheet-engaging members relative to said support in and counter to said direction.

47. Apparatus as defined in claim 46, wherein said last mentioned moving means receives motion from said portion of said second conveyor means.

48. Apparatus for converting a stream of sheets, particularly a stream of partly overlapping signatures, into a row of substantially fully overlapping sheets, comprising first conveyor means having a sheet supporting surface; means for moving said first conveyor means in a predetermined direction; a plurality of spaced-apart distancing means movable with said conveyor means, said distancing means being disposed one behind the other, as considered in said direction, and extending beyond said supporting surface; second conveyor means defining a predetermined path for the transport of sheets which form said stream to said supporting surface intermediate two successive distancing means whereby such sheets form a growing row of predetermined width, as considered transversely of said direction, which accumulates on said supporting surface, said second conveyor means including a portion adjacent said supporting surface and means for moving said portion back and forth substantially in and counter to said direction against and away from the last sheet of said growing row to thereby provide room for advancement of the foremost sheet of said stream behind the last sheet of the growing row, each of said distancing means having a width which is less than said predetermined width so that a portion of a row on said supporting surface extends laterally beyond at least one side of said two successive distancing means; and means for removing fully grown rows from said supporting surface, including means for engaging said laterally extending portions of such rows.

49. Apparatus for converting a stream of sheets, particularly a stream of partly overlapping signatures, into a row of substantially fully overlapping sheets, comprising first conveyor means having a sheet supporting surface; means for moving said first conveyor means in a predetermined direction; a plurality of spaced-apart distancing means movable with said conveyor means, said distancing means being disposed one behind the other, as considered in said direction, and extending beyond said supporting surface; second conveyor means defining a predetermined path for the transport of sheets which form said stream to said supporting surface intermediate two successive distancing means whereby such sheets form a growing row which accumulates on said supporting surface, said second conveyor means including a portion adjacent said supporting surface and means for moving said portion back and forth substantially in and counter to said direction against and away from the last sheet of said growing row to thereby provide room for advancement of the foremost sheet of said stream behind the last sheet of the growing row; a mobile support for said portion of said second conveyor means; means for moving said support in and counter to said direction; and means for changing the speed of said first mentioned moving means in response to movement of said support.

50. Apparatus for converting a stream of sheets, particularly a stream of partly overlapping signatures, into a row of substantially fully overlapping sheets, comprising first conveyor means having a sheet supporting surface; means for moving said first conveyor means in a predetermined direction; a plurality of spaced-apart distancing means movable with said conveyor means, said distancing means being disposed one behind the other, as considered in said direction, and extending beyond said supporting surface; second conveyor means defining a predetermined path for the transport of sheets which form said stream to said supporting surface intermediate two successive distancing means whereby such sheets form a growing row which accumulates on said supporting surface, said second conveyor means including a portion adjacent said supporting surface and means for moving said portion back and forth substantially in and counter to said direction against and away from the last sheet of said growing row to thereby provide room for advancement of the foremost sheet of said stream behind the last sheet of said growing row; and means for removing fully grown rows from said supporting surface, including a first vehicle movable in and counter to a second direction and a second vehicle arranged to receive rows from said first vehicle and movable in and counter to a third direction.

51. Apparatus as defined in claim 50, wherein said supporting surface is substantially horizontal and said first vehicle is movable between a level below and a level above said supporting surface, said second vehicle being located at a level above said supporting surface.

52. Apparatus for converting a stream of sheets, particularly a stream of partly overlapping signatures, into a row of substantially fully overlapping sheets, comprising first conveyor means having a sheet supporting surface; means for moving said conveyor means in a predetermined direction; a plurality of spaced-apart distancing means movable with said conveyor means, said distancing means being disposed one behind the other, as considered in said direction, and extending beyond said supporting surface; second conveyor means defining a predetermined path for the transport of sheets which form said stream to said supporting surface intermediate two successive distancing means whereby such sheets form a growing row having a predetermined width, as considered transversely of said direction, which accumulates on said supporting surface, each of said distancing means having a width less than said predetermined width so that a portion of a row on said supporting surface extends laterally beyond at least one side of said two successive distancing means, said second conveyor means having a portion which is adjacent said supporting surface and is movable back and forth in and counter to said direction; means for moving said portion back and forth between first and second end positions in one of which said portion bears against the last sheet of the growing row or against the foremost sheet of said stream to push such sheet in said direction and in the other of which said portion provides room for movement of the foremost sheet of said stream toward said supporting surface; and means for removing fully grown rows from said supporting surface, including means for engaging said laterally extending portions of such rows.

53. Apparatus for converting a stream of folded sheets, particularly a stream of partially overlapping signatures, into a row of substantially fully overlapping sheets, comprising first conveyor means having a sheet supporting surface; means for moving said conveyor means in a predetermined direction; second conveyor means defining a predetermined path for the transport of sheets which form said stream toward said supporting surface whereby such sheets form a growing row having a predetermined width, as considered transversely of said direction, which accumulates on said supporting surface and is moved in said direction, the width of said supporting surface being less than said predetermined width so that a portion of a row on said supporting surface extends laterally beyond at least one side of said first conveyor means; means for compacting successive folded sheets of said stream before such sheets reach said supporting surface; and means for removing fully grown rows from said supporting surface, including means for engaging said portions of such rows.

54. In an apparatus for converting a stream of partially overlapping paper sheets into a row of sheets, a combination comprising first endless conveyor means having a substantially horizontal upper reach; distancing elements mounted on said conveyor means, said distancing elements being spaced apart from each other and substantially normal to said conveyor means; second endless conveyor means comprising a plurality of transversely spaced first endless bands each having a front reach movable in the region of one end of said first conveyor means toward and substantially at right angles to said upper reach and at least one second endless band having a rear reach parallel with and closely adjacent the front reaches of said first bands and movable in the same direction as said front reaches so that a stream of paper sheets may be received between said front reaches and said rear reach and fed onto said top reach of said first conveyor means, said second band having a lower end located above and spaced apart from said upper reach by a distance slightly exceeding the height of sheets on said upper reach, said first endless bands including a plurality of vertically arranged sections and said sections including an end section adjacent said upper reach; drive means connected with said first conveyor means for moving said upper reach in a direction from said one end toward the other end of said first conveyor means; a pair of transversely spaced bearing members suspended above said upper reach of said first conveyor means; a shaft having end portions mounted in said bearing members and provided with a plurality of rollers for said bands of said end section and additional rollers for the bands of the section preceding said end section, said bearing members being suspended in such a way that said end section is movable to and fro substantially parallel to itself; means for biasing said end section in the direction of movement of said upper reach of said first conveyor means; pusher means disposed in the region of said end section adjacent said upper reach and outside of the path of said first bands of said second conveyor means and of the path of said distancing elements, said pusher means having a portion closely adjacent said upper reach and movable in substantial parallelism with said upper reach between a first end position forwardly of said front reaches and a second end position rearwardly of said front reaches for pushing the sheets which are transported by said second conveyor means with a predetermined force against one of said distancing elements on said upper reach as the latter moves in said directions; and means for moving said portion of said pusher means between said end positions.

55. A combination as defined in claim 54, wherein said pusher means comprises a plurality of transversely spaced fingers connected to each other, said bearing members including a second shaft on which said fingers are supported adjacent the upper ends thereof, and further comprising means for imparting to said fingers an oscillatory movement about the axis of said second shaft.

56. A combination as defined in claim 55, wherein said means for imparting oscillatory movement to said fingers comprises a driven roller mounted for rotation in said bearing members and having an eccentric pin, and a connecting rod having end portions pivotally connected with said pin and said fingers.

57. A combination as defined in claim 54, further comprising an additional shaft mounted in fixed wall means above and in parallelism with said first mentioned shaft, at least one lever for suspending said bearing members on said additional shaft, said biasing means including two weighted rods located rearwardly of said bearing members, as considered in the direction of movement of said upper reach, means for guiding said rods for vertical movement, and two parallel links for each weighted rod, said links forming part of a parallel motion mechanism which connects said bearing members to said rods.

58. A combination as defined in claim 57, wherein said drive means for said first conveyor means comprise a variable-speed motor and one of said weighted rods includes a cam face, and further comprising means for regulating the speed of said motor, said regulating means cooperating with said cam face for adjusting the speed of said motor and of said first conveyor means independently of said end section of said first endless bands of said second conveyor means.

59. A combination as defined in claim 58, wherein said motor is an air motor and said regulating means comprises a valve arranged to regulate the quantity of air which is supplied to said motor.

60. In an apparatus for converting a stream of partially overlapping paper sheets into a row of sheets, a combination comprising first endless conveyor means including two transversely spaced endless flexible members each having an upper reach; distancing elements mounted on said conveyor means, said distancing elements being spaced apart from each other, substantially normal to said conveyor means and forming a plurality of transversely aligned pairs on said flexible members; second endless conveyor means comprising at least one first endless band having a front reach movable in the region of one end of said first conveyor means toward and substantially at right angles to said upper reaches and at least one second endless band having a rear reach parallel with and closely adjacent the front reach of said first band and movable in the same direction as said front reach so that a stream of paper sheets may be received between said front reach and said rear reach and fed onto said upper reaches of said flexible members, said second band having a lower end located above and spaced apart from said upper reaches by a distance slightly exceeding the height of sheets on said upper reaches; drive means connected with said first conveyor means for moving said upper reaches in a direction from said one end toward the other end of said first conveyor means; pusher means disposed in the region of said one end of said first conveyor means adjacent said upper reaches and outside of the path of said first band of said second conveyor means and of the path of said distancing elements, said pusher means having a portion closely adjacent said upper reaches and movable in substantial parallelism with said upper reaches between a first end position forwardly of said front reach and a second end position rearwardly of said front reach for pushing the sheets which are transported by said second conveyor means with a predetermined force against one pair of said distancing elements on said upper reaches as the latter move in said direction; means for moving said portion of said pusher means between said end positions; and a carriage disposed between said flexible members and parallel to said upper reaches, said carriage being movable up and down in a direction substantially normal to said upper reaches as well as to and fro in and counter to the direction of movement of said upper reaches, said carriage including a pair of arms projecting upwardly from the opposite ends thereof and being spaced apart from each other a distance equal to the spacing of successive pairs of distancing elements.

61. A combination as defined in claim 60, further comprising a pair of rails extending transversely of said upper reaches of said flexible members at a level above said first conveyor means, a trolley mounted on said rails for lengthwise movement thereon and having end portions spaced apart from each other a distance greater than the spacing of said arms of said carriage, clamping jaws extending downwardly from said end portions of said trolley, and means for moving one of said jaws toward the other of said jaws so that a row of sheets which is assembled between successive pairs of distancing elements on said upper reaches can be transferred by said carriage between said jaws and clamped therebetween, to be thereupon transported in a direction transversely of said first conveyor means by moving said trolley along said rails.

62. A combination as defined in claim 60, further comprising rail means extending in the longitudinal direction of the upper reach of said first conveyor means and supporting said carriage for movement therealong, means for moving said carriage along said rail means, an upright sleeve connected to one end of said rail means, an upright column extending through said sleeve, and means for moving said sleeve up and down along said column together with said rail means and said carriage.

* * * * *